US007758305B2

(12) United States Patent
Kurszewski et al.

(10) Patent No.: US 7,758,305 B2
(45) Date of Patent: Jul. 20, 2010

(54) CENTRIFUGAL FAN WITH TURBULENCE INDUCING INLET BELL

(75) Inventors: Scott S. Kurszewski, Wittenberg, WI (US); Timothy Kuski, Mosinee, WI (US)

(73) Assignee: Greenheck Fan Corporation, Schofield, WI (US)

( * ) Notice: Subject to any disclaimer, the term of this patent is extended or adjusted under 35 U.S.C. 154(b) by 694 days.

(21) Appl. No.: 11/539,485

(22) Filed: Oct. 6, 2006

(65) Prior Publication Data

US 2008/0085186 A1 Apr. 10, 2008

(51) Int. Cl.
*F04D 29/44* (2006.01)

(52) U.S. Cl. ..... 415/205; 415/206

(58) Field of Classification Search ..... 415/204, 415/205, 206

See application file for complete search history.

(56) References Cited

U.S. PATENT DOCUMENTS 2,781,963 A * 2/1957 Faber ..... 416/183
3,412,929 A 11/1968 Greenheck
3,425,621 A 2/1969 Greenheck
3,584,968 A 6/1971 Keith
3,650,633 A 3/1972 Benoit
4,345,874 A * 8/1982 Ozeki et al. ..... 415/9
4,890,547 A * 1/1990 Wagner et al. ..... 454/356
5,547,339 A * 8/1996 Burgers ..... 415/119
5,803,709 A * 9/1998 Matthews et al. ..... 415/182.1
5,810,557 A 9/1998 Akinkuotu et al.
6,042,335 A 3/2000 Amr
7,048,499 B2 5/2006 Mathson et al.

* cited by examiner

*Primary Examiner*—Edward Look
*Assistant Examiner*—Ryan H Ellis
(74) *Attorney, Agent, or Firm*—Merchant & Gould P.C.

(57) ABSTRACT

A centrifugal fan has an inlet bell that induces turbulence in the intake air stream so as to better distribute air across the rotating radial fan blades and thereby increase fan efficiency. The "turbulator" feature is one or more preferably arcuate surfaces integrally formed in the inlet bell to either project into or away from the intake air stream. The turbulator disrupts smooth air flow across the inside surface of the inlet bell has the effect of randomizing the air at the boundary layer to reduce separation of the air from the inlet bell as it leaves the inlet bell and enters the impeller. The air can thus follow the contour of the inlet bell more closely to make a tighter radius turn as it enters the impeller. In so doing, air is delivered across more of the fan blades so that output air flow is increased.

15 Claims, 4 Drawing Sheets

CENTRIFUGAL FAN WITH TURBULENCE INDUCING INLET BELL

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

1. Technical Field

The present invention relates generally to an in-line centrifugal fan, and in particular, to a centrifugal fan having a high operating efficiency and reduced sound.

2. Description of the Related Art

High performance fans are used in variety of industrial and laboratory applications to rapidly evacuate a large volume of air into, out of or through a building. The performance and desirability of a fan is measured generally by the fan's efficiency and sound levels produced during operation. The optimization of these two components will reduce the energy needed to operate the fan and/or increase output flow, thus conserving cost, and will further reduce the noise pollution associated with operation.

Fans are generally classified according to the direction of airflow through the impeller. In particular, axial flow fans are characterized by flow through the impeller in a direction generally parallel to the shaft axis. Centrifugal fans receive airflow into the impeller axially, and redirect the airflow radially outward. In-line mixed flow centrifugal fans are characterized in that the air enters the impeller axially and is deflected at an obtuse angle by the impeller blades such that the air flowing out of the impeller has both axial and radial flow components.

Centrifugal fans typically have a squirrel cage type impeller with multiple spaced apart fan blades that direct the air either radially, or both radially and axially. The fan blades are typically mounted to a wheel back that supports the fan blades as well as mounts to the shaft of a motor so that the impeller can rotate as the shaft is turned. The front end of the fan blades are mounted to a "wheel cone" that rotates with the impeller. The wheel cone cooperates with an inlet bell mounted in front of the impeller to funnel intake air into the impeller.

As disclosed in U.S. Pat. No. 7,048,499, the wheel back can be spherical and the wheel cone can be frusto-conical so as to mount the fan blades at an oblique angle with respect to the intake air flow to be better deliver the air to the fan blades. Specifically, by using specially designed fan blades, a conical wheel cone and angling the fan blades, the intake air can be distributed along most of the area of the fan blades, to thus output air flow efficiently.

This patent, and other prior art fan designs, focus on improving the impeller design through unique airfoil fins or twisted flat fin designs, rather than on improving how the air enters the wheel. However, the complex fan blades designs, convex wheel back and partial cone shape of the wheel cone complicates the fan design and manufacturing, and thereby increases cost, by requiring the fan blades to be formed with complex three-dimensional surfaces.

Accordingly, an improved centrifugal fan is need that improves fan efficiency and decreases noise without requiring a complex impeller configuration.

SUMMARY OF THE INVENTION

The present invention provides a centrifugal fan having increased output efficiency and decreased noise resulting from improved distribution of intake air along a greater area of radial fan blades.

Specifically, the invention is a centrifugal fan having a wheel mount with a shaft that carries an impeller for rotation about a shaft axis. The impeller has a plurality of fan blades, a wheel back and a wheel front. Each fan blade extends a length between the wheel front and the wheel back. The wheel front is fixed to a front end of the fan blades, and the wheel back is fixed to a back end of the fan blades and mounts the impeller to the shaft for rotation about the shaft axis. The fan can be unhoused as shown in FIG. 1 or it can be housed such as a single wide or double wide centrifugal fan. An inlet bell has a wall defining a passageway for directing air to a front end of the impeller. The passageway has a first opening and a second opening downstream from and of a lesser dimension than the first opening. The wall has an integral turbulator for inducing turbulence in the air passing through the passageway such that air passing into the impeller is contacted by the fan blades along essentially the length of each blade.

The turbulator can take any suitable form sufficient to induce turbulence in the air at the boundary layer where the air meets the inside wall of the inlet bell, including without limitation any deformation, indention, protrusion having one or more flat or arcuate surfaces. However, preferably it is formed integrally with the inlet bell wall as at least one arcuate surface projecting toward or away from the passageway to a greater extent than an adjacent surface of the wall. For example, the arcuate surface can be convex or concave with respect to the passageway. Moreover, the turbulator could be a single discretely located element, or it could be several elements located in series or in a prescribed or random pattern about some portion or the entire inside surface of the inlet bell. For example, the arcuate surface can extend in a continuous ring about the shaft axis. Moreover, it can be located at any suitable front to back location on the inlet bell. For example, the arcuate surface can be located between the first opening and an axial midpoint of the inlet bell, such as adjacent to the first opening.

The wall of the inlet bell generally has a smooth contour following as straight line or large radii, while the arcuate surface of the turbulator has a much smaller radius. The relatively small radius contour of the turbulator provides the disruption of smooth laminar type flow over the large radius contours of the inlet bell to thereby induce turbulence in the air. The random flow of the turbulent air thus reduces of separation of the air from the large radius contours of the inlet bell downstream from the turbulator at the inlet bell/impeller interface so that the air will travel in the direction of curvature of the inlet bell. Thus, at least some of the air follows a path that turns at an angle of less than 90 degrees as it passes from the inlet bell to the impeller.

Thus, the centrifugal fan has an inlet bell that induces turbulence in the intake air stream so as to better distribute air across the rotating radial fan blades and thereby increase fan efficiency. The "turbulator" feature is one or more surfaces integrally formed in the inlet bell to either project into or away from the intake air stream. The turbulator disrupts smooth air flow across the inside surface of the inlet bell has the effect of randomizing the air at the boundary layer to reduce separation of the air from the inlet bell as it leaves the inlet bell and enters the impeller. The air can thus follow the contour of the inlet bell more closely to make a tighter radius turn as it enters the impeller. In so doing, air is delivered across more of the fan blades so that output air flow is increased.

These and other advantages of the invention will be apparent from the detailed description and drawings. What follows is are preferred embodiments of the present invention. To assess the full scope of the invention the claims should be looked to, as the preferred embodiments are not intended as the only embodiments within the scope of the invention.

DETAILED DESCRIPTION OF THE PREFERRED EMBODIMENTS

Figure 1:
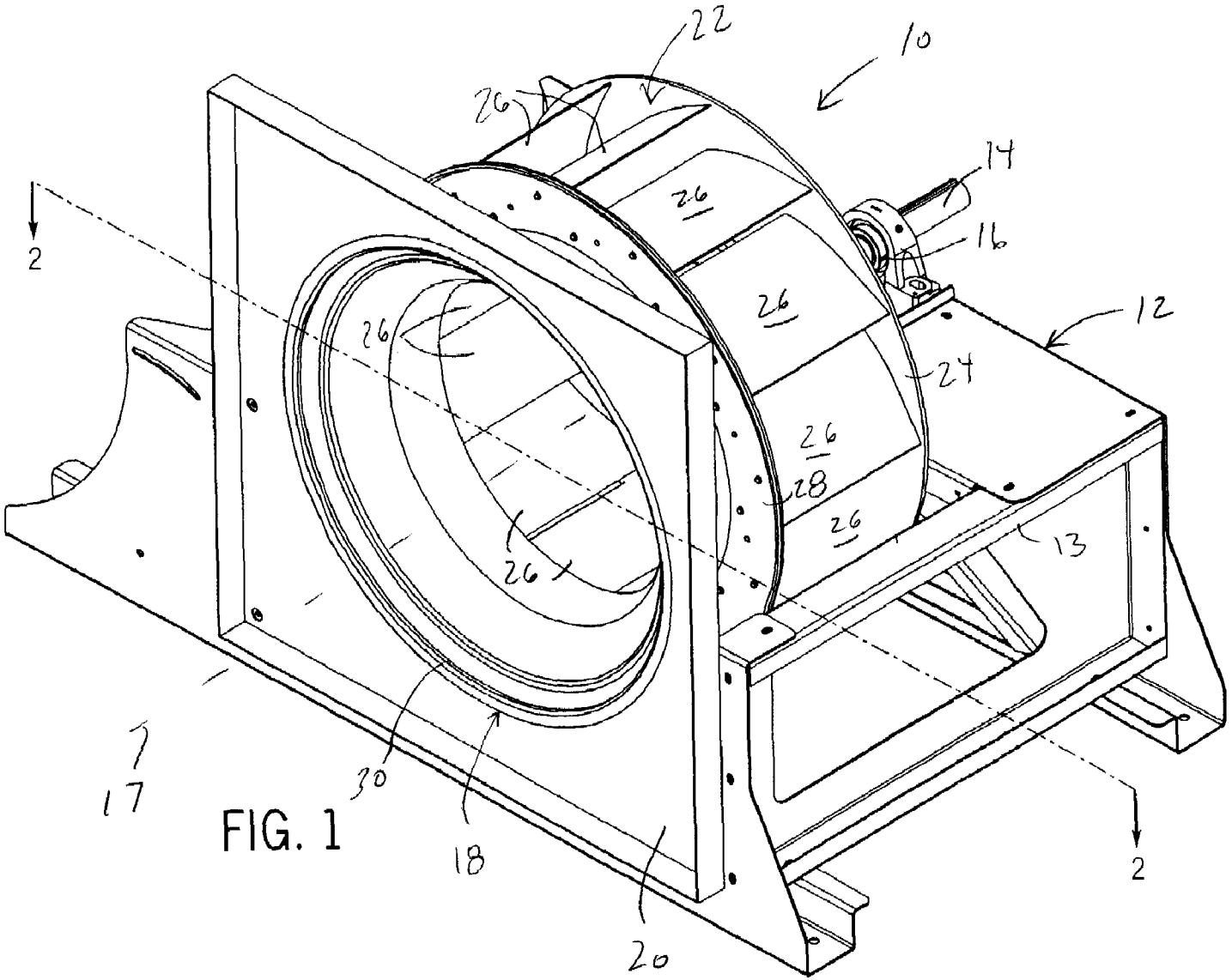
FIG. 1 is a perspective view of an unhoused centrifugal fan assembly according to the present invention.
Figure 2:
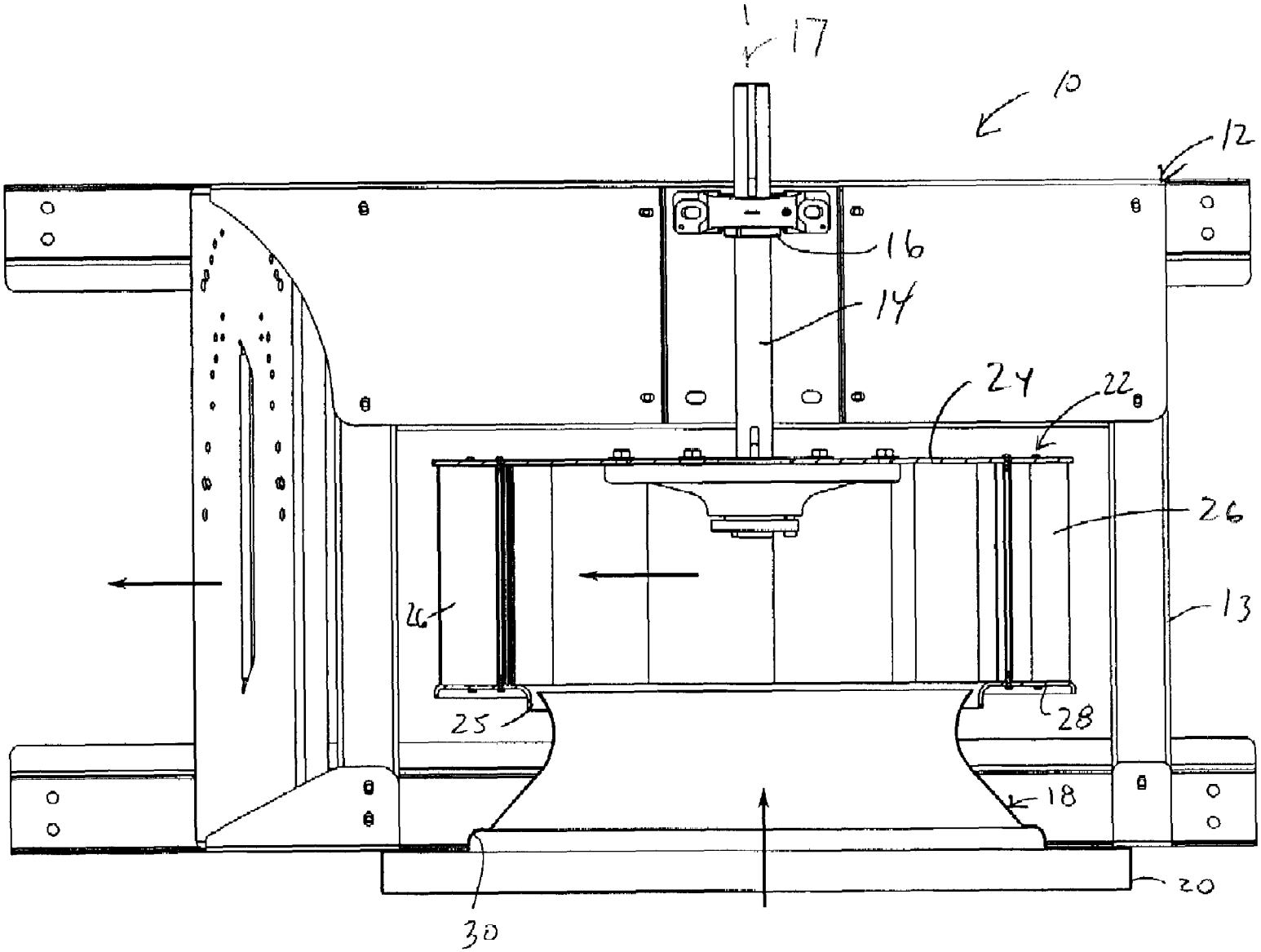
FIG. 2 is a top sectional view thereof taken along line 2-2 of FIG. 1.

Referring initially to FIGS. 1 and 2, an in-line centrifugal fan 10, includes a wheel mount 12 having supporting framework 13 and a rotatable shaft 14 and bearing 16 assembly to which is coupled an electric motor (not shown) via a direct drive or drive pulley arrangement (not shown). The shaft 14 extends along a shaft axis 17. It should be appreciated that various motor sizes and drive combinations are available to produce fans capable of circulating air at various flow rates.

A fan constructed in accordance with the present invention achieves a reduced brake horsepower needed to achieve the same airflow compared to the prior art, thereby resulting in a significantly greater efficiency. Additionally, the present invention achieves a dramatic reduction in sound levels during operation at any given fan static pressure. The sound pressure emanating from a fan constructed in accordance with the present invention is significantly less than the sound pressure emanated from the prior art, thereby reducing noise pollution and the hazardous health effects known to result therefrom. Thus, the present invention is more efficient than the prior art, thereby conserving an appreciable amount of energy and operating expense, and operates at lower decibels than the prior art.

The inlet bell 18 receives air from the ambient environment that is to be circulated by the fan 10. The inlet bell 18 funnels air to an impeller 22 that is mounted to the shaft 14 and is disposed axially downstream of the inlet bell 18. In particular, the impeller 22 includes a flat, disk-shaped wheel back 24 having an opening that mounts to the shaft 14 so that it and the rest of the impeller 18 rotate under the power of the motor. A plurality of fan blades 26 are welded, or otherwise connected via any suitable mechanical fastener, to the wheel back 24 at their back ends. The front ends of the fan blades 26 are similarly connected to a wheel front 28, sometimes referred to in the industry as a "wheel cone" for its partial cone shape in many instances. The wheel front 28 is disposed downstream of, and spaced apart from, the inlet bell 18 and rotates along with the fan blades 26 and the wheel back 24 during operation. The wheel front 24 is a ring shape with a turned axial lip 25 at its inner diameter that defines an impeller inlet receiving air from inlet bell 18. Accordingly, air travels through the intake end of the fan into inlet bell 18, and further through the impeller 22 under the forces provided by the fan blades 26 as they rotate. The air circulated by the fan 10 is then directed radially outward from the fan blades 26, generally perpendicular to the axial direction of the bulk air flow through the inlet bell 18.

The axial length and radial width of the impeller 22 is 10.5 inches and 30.0 inches, respectively. As mentioned, the fan blades 26 are aligned therein and geometrically configured to create a radial flow during operation of the fan 10. Twelve fan blades 26 are used in accordance with the preferred embodiment. The use of twelve fan blades results in lower operating speed for a given operating point and better sound characteristics, however, the number of blades can vary to change the performance of the fan. Each fan blade 26 has an airfoil shape with a thicker intermediate section that narrows to the straight leading and trailing edges. The front and back ends are flat and each fan blade 26 follows a smooth airfoil shape preferably having a fin chord length of 8.2 and an axial width of 10.5 inches concave in the direction of the shaft axis 17. The flat ends and straight leading and trailing edges make the fan blades 26 themselves, and in turn, the impeller 22 generally much more simple to design and manufacture. Yet, the fan 10 still provides efficiency and sound improvements over the more complex impeller systems having complex blade shapes, blade angles and fin camber radius combinations.

While there are several variables that can affect the performance of a fan, the improved aerodynamic and acoustic performance of the disclosed fan 10 is achieved by the design of inlet bell 18, and in particular, a turbulator feature 30 (or 30A), described in detail below.

Generally, the transition of the air moving from the inlet bell 18 to the impeller 22 can influence the performance of the fan significantly. The air gap, impeller position and entrance angle variables are so important that variations from manufacturing tolerances can cause extreme shortfalls in both air and sound performance of the fan 10. Since the ideal entrance angle varies with impeller speed, the fan is actually only tuned for a narrow speed range. Outside this range, some of the inefficiencies are due to the air separating from the inlet bell 18 resulting in less of the fan blades 26 being utilized to increase airflow. This happens because at the exit of the inlet bell 18 the area increases from the throat causing a decrease in air velocity, and decelerated flow is prone to separation. Additional inefficiencies are due to airflow not attaching to the fan blades 26. It is well known to those of skill in the art that separation is normally accompanied by a sharp increase in resistance. By disturbing the air upon entrance into the inlet bell 18, it is possible to not only increase the optimal speed range, but also increase the air performance and reduce the sound of the fan 10.

This is accomplished by the turbulator feature 30 (or 30A) of the inlet bell 18. This disturbed, turbulent air has better adhesion, and therefore is less prone to separation. With increased adhesion to the inlet bell 18, separation is reduced and the air is able to turn into the impeller more sharply to be better distributed along the entire length of each fan blade 26. This is especially beneficial on flat wheel front designs where the turn into the impeller is more aggressive.

With the air headed in the proper direction, the air gap, impeller position and entrance angle variables are not as critical. The result is efficient transference of the air from the inlet bell 18 to the impeller 22 over a wide range of operation parameters. In addition, with the air entering the wheel correctly, more of the fin will be utilized to increase output airflow. The turbulent flow also helps the air to adhere to the inner, low-pressure side of the fan blades 26 and the result is less separation from the fan blades 26, which means that the fan blades 26 will produce more work and have less overall drag and noise. The result is a highly efficient quiet fan. A turbulent boundary layer does have more surface friction but the benefits of reducing separation overcome this.

Figure 3:
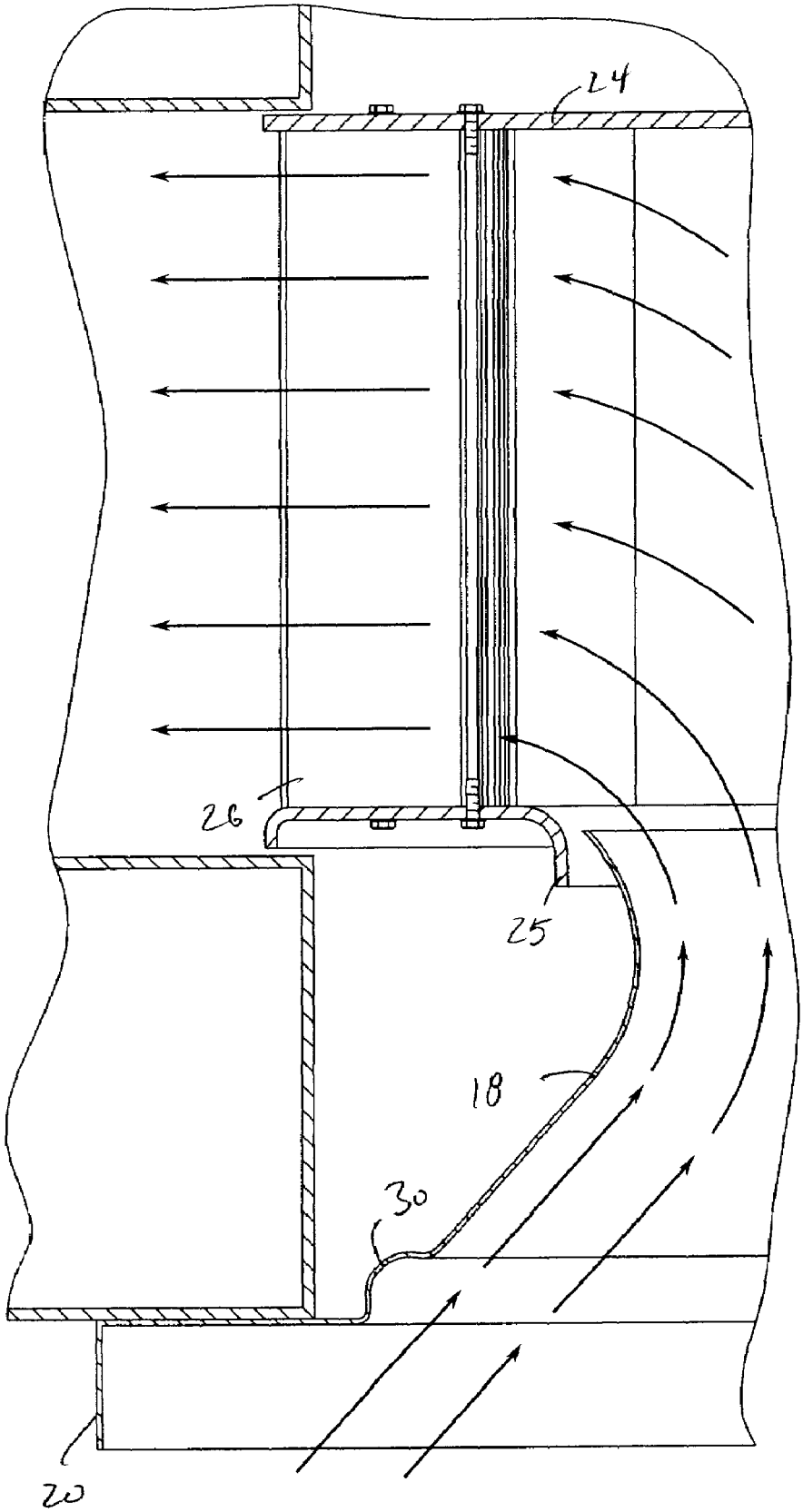
FIG. 3 is an enlarged, partial sectional view thereof.
Figure 4:
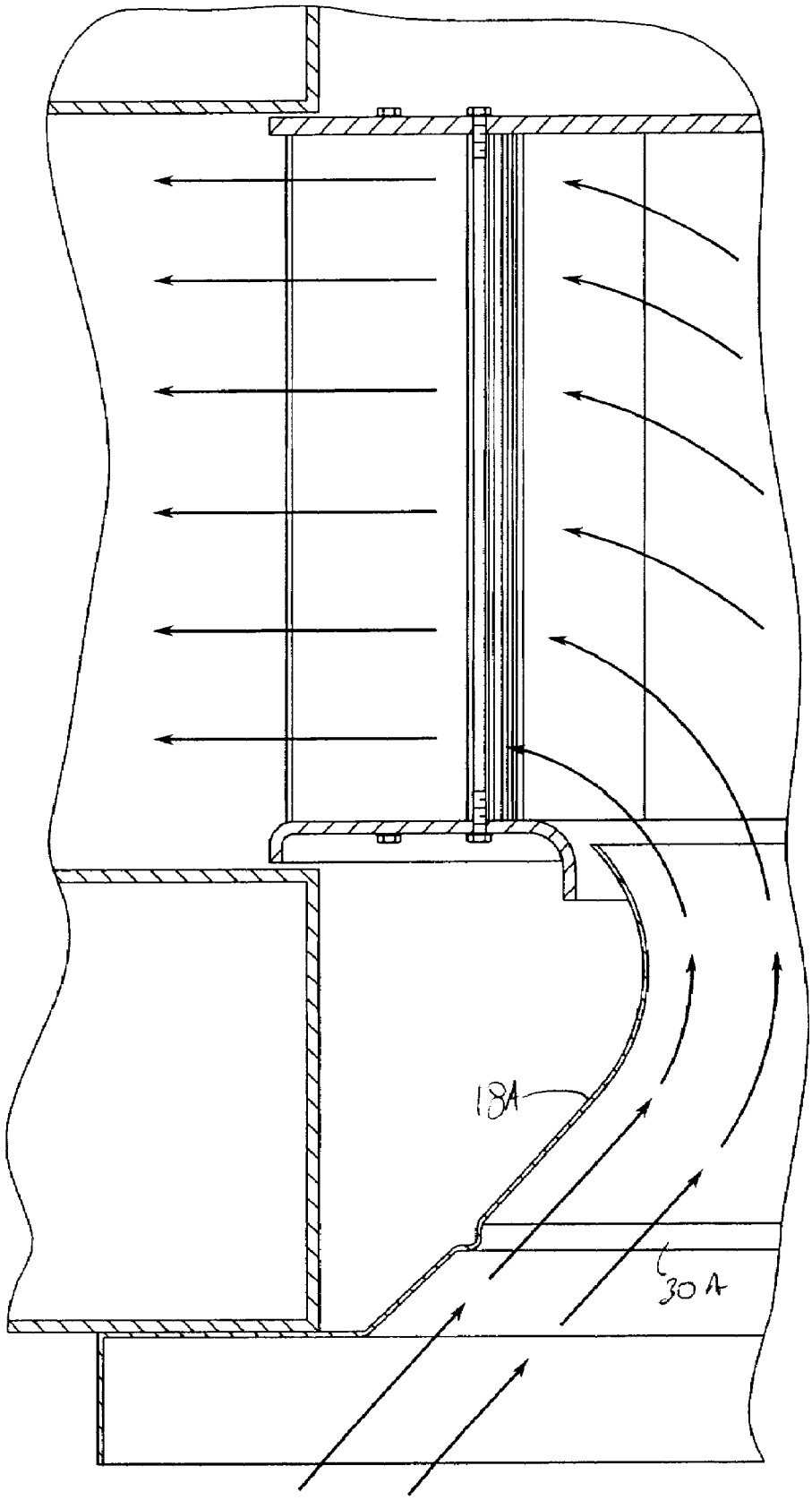
FIG. 4 is a view similar to FIG. 3 albeit of an alternate embodiment of the inlet bell and turbulator.

Two examples of the turbulator 30 and 30A are shown in FIGS. 3 and 4, respectively. FIG. 3 shows an integral recessed section formed into the inlet bell 18. FIG. 4 shows a convex shaped disturbance formed into the inlet bell 14. It should be understood that these are only two examples of many possible configurations that can be used to induce turbulence in the air. One or multiple turbulator elements may be used, and the turbulator may be at one or more discrete locations on the inlet bell, or as shown it may form a continuous ring about the shaft axis. Moreover, the turbulator can be integrally formed in the inlet bell by any suitable manufacturing technique, such as spinning or drawing. Thus, the disclosed embodiments should not limit the scope of the invention in any way.

The inlet bell 18 has a single, continuous partial bell-shaped wall having a smoothly contoured, radially tapering cross-section, in which the turbulator 30 (or 30A) is integrally formed. With regard to the embodiment of FIG. 3, the inlet bell 18 defines a discharge diameter of approximately 20.5 inches and fits radially inside of the lip 25 of the wheel front 28, which has an inner diameter of 20.7 inches. The discharge diameter of the inlet bell 18 has been maximized in order to minimize the air velocity over the transition between the inlet bell 18 and the wheel front 28, but could be any suitable dimension providing space sufficient not to interfere with rotation of the wheel front 28 during operation of the fan 10. The inlet bell 18 has an intermediate throat diameter of approximately 18.9 inches, though it could be anywhere within the range of 20.5 and 16.0 inches. The inlet bell 18 has an entry diameter of 27.5 inches, which could be in a range of 32.0 and 22.0 inches. The inlet bell 18 has an axial length of approximately 7.6 inches, but could be anywhere within the range of 15.0 and 4.0 inches. Greater lengths were not shown to increase efficiency, and it is desirable to keep the length L as small as possible so as to produce a compact fan 20. The inlet bell 18 forms a discharge angle with respect to the axial direction of approximately 40 degrees, but could be anywhere between 60 and 30 degrees.

The turbulator 30 is formed in the inlet bell 18 as a continuous smooth ring that is concave with respect to the air flow through the inlet bell 18. The smooth arcuate surface of the turbulator 30 is continuous with the rest of the wall forming the inlet bell 18, however, it projects in a direction away from the air stream unlike the inwardly tapering section of the inlet bell 18 leading to the throat. Moreover, the arcuate surface of the turbulator 30 has a much smaller radius, than the straight or large radius sections of the inlet bell 18 adjacent to and downstream from the turbulator 30. The radius of the arcuate surface of the turbulator 30 is 0.1 to 0.75 inches, as compared to the adjacent straight conical section or the curved throat, which has a radius of 2.8 inches. The significant difference in curvature, or inner diameter, between the turbulator 30 and the adjacent sections of the inlet ball 18 disrupts what may otherwise be smooth laminar flow across the inside surface of the inlet bell 18, and instead effects turbulence or random direction non-laminar air flow at the boundary layer. As mentioned above, this increasing adhesion to the inlet bell 18 so that the air follows the contour of the inlet bell 18 along the throat and to the discharge diameter. With reduced separation, the air is able to turn into the impeller 22 more sharply to be better distributed along the entire length of each fan blade 26, and especially to make contact with the areas of the fan blades 26 near the front ends where it may otherwise fail to make contact if the air where to separate from the inlet bell 18 too soon, for example, at the throat. The air is able to follow the contour of the inlet bell 18 so as to turn through an angle of less than 90 degrees as it passes from the inlet bell 18 to the impeller 22, and more preferably an even more acute angle of between 40 and 50 degrees.

With regard to the embodiment of FIG. 4, the inlet bell 18A defines a discharge diameter of approximately 20.5 inches. The discharge diameter of the inlet bell 18A has been maximized in order to minimize the air velocity over the transition between the inlet bell 18A and the wheel front 28, but again could be any suitable dimension providing space sufficient not to interfere with rotation of the wheel front 28 during operation of the fan 10. The inlet bell 18A has an intermediate throat diameter of approximately 18.9 inches, though it could be anywhere within the range of 20.5 and 16.0 inches. The inlet bell 18A has an entry diameter of 27.5 inches, which could be in a range of 32.0 and 22.0 inches. The inlet bell 18A has an axial length of approximately 7.6 inches, but could be anywhere within the range of 15.0 and 4.0 inches. The inlet bell 18A forms a discharge angle with respect to the axial direction of approximately 40 degrees, but could be anywhere between 60 and 30 degrees.

Like in the embodiment of FIG. 3, the turbulator 30A is formed in the inlet bell 18A as a continuous smooth ring, however, here it is convex with respect to the air flow through the inlet bell 18. The smooth arcuate surface of the turbulator 30A is also continuous with the rest of the wall forming the inlet bell 18A, however, it is spaced back from the entry diameter, preferably 0.5 to 2.0 inches. Again, the arcuate surface of the turbulator 30A has a much smaller radius, such as 0.1 to 0.75 inches, than the straight or large radius sections of the inlet bell 18A adjacent to and downstream from the turbulator 30A. The significant difference in curvature, or inner diameter, effects turbulence in the air and provides the beneficial adhesion to the inlet bell 18A wall to better distribute the air along the entire length of each fan blade 26.

The above describes various constructions and dimensions for various parts of the fan that achieve certain advantages over the prior art. It should be appreciated that the dimensions are approximate to reflect changes due to tolerances in manufacturing as is easily appreciated by one having ordinary skill in the art. In particular, the sound levels produced by fan 10 are magnitudes less than prior art fans, and the efficiency of fan 10 is greatly increased with respect to conventional fans. Accordingly, the present invention is intended to encompass any fan achieving a greater efficiency and/or reduced noise production than the prior art, as defined by the appended claims. Furthermore, as described above, fan 10 is easier to assemble, manufacture, and install than the prior art.

The invention has been described in connection with what are presently considered to be the most practical and preferred embodiments. However, the present invention has been presented by way of illustration and is not intended to be limited to the disclosed embodiments. Accordingly, those skilled in the art will realize that the invention is intended to encompass all modifications and alternative arrangements included within the spirit and scope of the invention, as set forth by the appended claims.

We claim:

1. A centrifugal fan, comprising:

a wheel mount having a shaft rotatable about a shaft axis;

an impeller having a plurality of fan blades, a wheel back and a wheel front, the wheel front being fixed attached to a front end of the fan blades and the wheel back being fixedly attached to a back end of the fan blades and mounting the impeller to the shaft for rotation about the shaft axis, each fan blade extending a length between the wheel front and the wheel back;

an inlet bell having a wall defining a passageway for directing air to a front end of the impeller, the passageway having a first opening and a second opening downstream from and of a lesser dimension than the first opening, the wall having a turbulator for inducing turbulence in the air passing through the passageway such that air passing into the impeller is contacted by the fan blades along essentially the length of each blade; and wherein the turbulator is formed integrally with the inlet bell wall as at least one arcuate surface projecting toward or away from the passageway to a greater extent than an adjacent surface of the wall, and the arcuate surface is located between the first opening and an axial midpoint of the inlet bell.

2. The centrifugal fan of claim 1, wherein the arcuate surface is convex with respect to the passageway.

3. The centrifugal fan of claim 1, wherein the arcuate surface is concave with respect to the passageway.

4. The centrifugal fan of claim 1, wherein the arcuate surface extends in a continuous ring about the shaft axis.

5. The centrifugal fan of claim 1, wherein the arcuate surface is adjacent to the first opening.

6. The centrifugal fan of claim 1, wherein at least some of the air follows a path that turns at an angle of less than 90 degrees as it passes from the inlet bell to the impeller.

7. The centrifugal fan of claim 1, wherein the wall has an intermediate section that defines an intermediate opening of a lesser dimension than the second opening.

8. A centrifugal fan, comprising:

a wheel mount having a shaft rotatable about a shaft axis;

an impeller having a plurality of fan blades, a wheel back and a wheel front, the wheel front being fixed attached to a front end of the fan blades and the wheel back being fixedly attached to a back end of the fan blades and mounting the impeller to the shaft for rotation about the shaft axis, each fan blade extending a length between the wheel front and the wheel back;

an inlet bell having a wall defining a passageway for directing air to a front end of the impeller, the passageway having a first opening and a second opening downstream from and of a lesser dimension than the first opening, the wall having a turbulator formed integrally with the inlet bell wall as at least one arcuate surface projecting toward or away from the passageway to a greater extent than an adjacent surface of the wall so as to induce turbulence in the air passing through the passageway such that air passing into the impeller is contacted by the fan blades along essentially the length of each blade; and wherein the arcuate surface is located between the first opening and an axial midpoint of the inlet bell.

9. The centrifugal fan of claim 8, wherein the arcuate surface is convex with respect to the passageway.

10. The centrifugal fan of claim 8, wherein the arcuate surface is concave with respect to the passageway.

11. The centrifugal fan of claim 10, wherein the arcuate surface extends in a continuous ring about the shaft axis.

12. The centrifugal fan of claim 8, wherein the arcuate surface is adjacent to the first opening.

13. The centrifugal fan of claim 8, wherein at least some of the air follows a path that turns at an angle of less than 90 degrees as it passes from the inlet bell to the impeller.

14. The centrifugal fan of claim 1, wherein the wall has an intermediate section that defines an intermediate opening of a lesser dimension than the second opening.

15. A centrifugal fan, comprising:

a wheel mount having a shaft rotatable about a shaft axis;

an impeller having a plurality of fan blades, a wheel back and a wheel front, the wheel front being fixed attached to a front end of the fan blades and the wheel back being fixedly attached to a back end of the fan blades and mounting the impeller to the shaft for rotation about the shaft axis, each fan blade extending a length between the wheel front and the wheel back and being parallel to the shaft axis;

an inlet bell having a contoured wall defining a passageway that narrows and then expands for directing air to a front end of the impeller, the passageway having a first opening and a second opening downstream from and of a lesser dimension than the first opening, the wall having a turbulator formed integrally with the inlet bell wall as at least one arcuate surface projecting toward or away from the passageway to a greater extent than an adjacent surface of the wall so as to induce turbulence in the air passing through the passageway such that air passing into the impeller travels in a path that turns less than 90 degrees so as to contact the fan blades near the front end; and wherein the arcuate surface is located between the first opening and an axial midpoint of the inlet bell.

* * * * *